US005554961A

United States Patent [19]

McCulloch

[11] Patent Number: 5,554,961

[45] Date of Patent: Sep. 10, 1996

[54] ENERGY EFFICIENT ELECTROMAGNETIC CIRCUIT

[76] Inventor: Doyle W. McCulloch, 803 Ave. C. No. 203, Garland, Tex. 75040

[21] Appl. No.: 387,448

[22] Filed: Feb. 13, 1995

[51] Int. Cl.[6] ..... H01H 51/22

[52] U.S. Cl. ..... 335/78; 335/177

[58] Field of Search ..... 335/78–86, 128, 335/131, 130, 124, 177–79

[56] References Cited

U.S. PATENT DOCUMENTS

| | | | |
|---|---|---|---|
| 2,632,072 | 3/1953 | Zellner | 335/78 |
| 3,914,723 | 10/1975 | Goodbar . | |
| 4,494,096 | 1/1985 | Fuzzell . | |
| 4,617,546 | 10/1986 | Kellogg et al. . | |
| 4,620,173 | 10/1986 | O'Brien . | |
| 4,998,082 | 3/1991 | Duimstra . | |
| 5,173,673 | 12/1992 | Weigand et al. | 335/18 |

*Primary Examiner*—Lincoln Donovan

*Attorney, Agent, or Firm*—Rosenblatt & Redano

[57] ABSTRACT

An energy efficient electromagnetic latching relay circuit. A permananet magnet having an attached electrical contact is free to move between two positions a second electrical contact is situated so that it engages the first contact only when the permanent magnet is in one of the two positions, thus completing the relay circuit. The electromagnet includes a magnetizable core disposed within a current conducting coil situated so that the magnetic field resulting from current within the coil can move the permanent magnet between the two positions. The magnetic field also induces a residual magnetism with the core which either attracts or repels the permanent magnet, thus latching the relay. The current is provided by a current source. Further provided is a switch for selecting the direction of current flow through the coil. A current storage device regulates the period during which current flows through the coil, limiting current flow to a period not substantially longer than necessary to move the permanent magnet and induce residual magnetism within the coil.

13 Claims, 1 Drawing Sheet

ENERGY EFFICIENT ELECTROMAGNETIC CIRCUIT

BACKGROUND OF THE INVENTION

1. Field of the Invention

The present invention relates to energy efficient electromagnetic circuits. The present invention relates specifically to an electromagnetic latching relay circuit.

2. Description of the Prior Art

Electromagnetic circuits are used to accomplish a wide variety of tasks. Typically such circuits utilize permanent magnets and/or electromagnets to accomplish the desired task. U.S. Pat. No. 3,914,723 to Goodbar, for example, discloses a magnetic latching relay using a permanent magnet and an electromagnet. The electromagnet, when activated, causes the permanent magnet to move, opening or closing a pair of contacts. Similar circuits are disclosed in U.S. Pat. No. 4,620,173 to O'Brien and U.S. Pat. No. 4,998,082 to Duimstra. Each of these use electric coils to create magnetic fields which move permanent magnets or electromagnets, thereby accomplishing some task. In each of the circuits disclosed, the electric coil is activated and consumes energy for some discrete period of time. The period may be arbitrarily longer than that necessary to accomplish the desired result, as when the coil is activated until the relay is switched, then deactivated at some arbitrary later time. The period may also correlate to the length of time the desired result is to be maintained, as when the coil is kept activated to "latch" the relay. In either case the electric coil consumes energy while it is activated. It is desirable to avoid this power consumption.

It is also known that certain materials, including Alnico alloys, may be readily induced with a "residual" magnetism. When exposed to a magnetic field of sufficient strength, these materials become magnetic and remain magnetic when the inducing magnetic field is removed. The polarity of the residual magnetism corresponds to the polarity of the inducing magnetic field, making these materials selectively magnetizable.

SUMMARY OF THE INVENTION

The present invention is an energy efficient electromagnetic latching relay circuit. A permanent magnet having an attached electrical contact is free to move between two positions. A second electrical contact is situated so that it engages the first contact only when the permanent magnet is in one of the two positions, thus completing the relay circuit.

An electromagnet including a magnetizable core disposed within a current conducting coil is situated so that the magnetic field resulting from current within the coil can move the permanent magnet between the two positions. The magnetic field also induces a residual magnetism within the core which either attracts or repels the permanent magnet, thus latching the relay.

The current is provided by a current source. The invention further comprises a switch for selecting the direction of current flow through the coil. A current storage device regulates the period during which current flows through the coil, limiting current flow to a period not substantially longer than necessary to move the permanent magnet and induce residual magnetism within the coil.

DETAILED DESCRIPTION OF THE PREFERRED EMBODIMENT

Figure 1A:
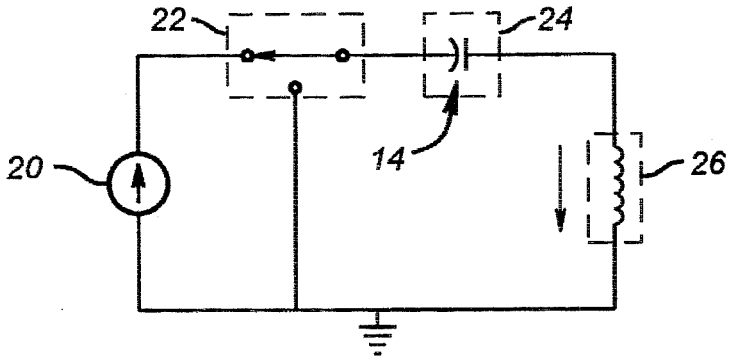
FIG. 1*a* is a circuit diagram illustrating the electrical connections for one embodiment of the present invention with the switching device in a first position.

The energy efficient electromagnetic circuit of the present invention includes a housing 26 preferably enclosing a permanent magnet 10, a first electrical contact 12, a second electrical contact 18, a magnetizable core 16, and a current conducting coil 14.

The permanent magnet 10 having north and south poles is slidably mounted within housing 26. The permanent magnet is moveable in either direction 32 between first and second delimiting positions. The distance between these two delimiting positions is preferably minimized.

The first electrical contact 12 or other electrically conducting member is attached to the permanent magnet, preferably with an insulating member 34 insulating the permanent magnet from electric current, and moves in tandem with the permanent magnet. The insulating member may also serve to prevent the flow of magnetic flux through the electrical contact 12. The first electrical contact is preferably enclosed within housing 26.

A second electrical contact 18 is fixed near electrical contact 12, preferably attached to the housing. This electrical contact 18 is positioned to engage electrical contact 12 only when the permanent magnet is moved to one of the two delimiting positions.

Aligned with the permanent magnet is an electromagnet comprising a magnetizable core 16 disposed within and magnetized by a current conducting coil 14. The electromagnet is positioned, preferably within housing 26, so that magnetics fields generated by current flow through the coil are substantially aligned with the north and south poles of the permanent magnet. The core is comprised of a material in which a residual magnetism may be readily induced, such as an Alnico alloy. The magnetic field generated by current flow through the coil induces such residual magnetism in the core.

Figure 3:
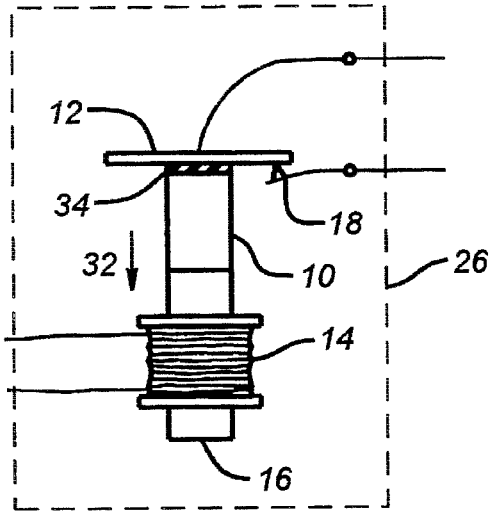
FIG. 3 is a front view of selected components of the present invention when the relay is latched in a closed position.

The electromagnet is positioned so that the magnetic field generated by a current through the coil is both aligned with the magnetic field of the permanent magnet and is capable of inducing movement of the permanent magnet by way of magnetic attraction or repulsion. As shown in FIG. 3, one of the delimiting positions of the permanent magnet may be abutting the magnetizable core. The electromagnet and electrical contact 12 are preferably encased within housing 26 along with the permanent magnet and electrical contact 18.

The circuit of the present invention also includes a current source 20, a current storage device 24, and a switching device 22. The current source provides direct current to the coil. In one embodiment, the current source is a battery. The switching device initiates current flow through the coil and preferably provides for selecting the direction of such flow and thus selecting the polarity of the magnetic field generated by the electromagnet. The current storage device limits the flow of current through the coil to a period not substantially longer than necessary to generate a magnetic field which moves the permanent magnet and induces residual magnetism in the core.

In operation, the switching device initiates a current flow through the coil. This generates a magnetic field which moves the permanent magnet from one of the delimiting positions to the other delimiting position, thereby engaging or disengaging electrical contacts 12 and 18, and induces a residual magnetism in the core. The current storage device then terminates current flow through the coil. The magnetizable core magnetically attracts or repels the permanent magnet, latching the relay circuit. Because current only flows through the coil for the period necessary to move the permanent magnet and induce residual magnetism in the core, no energy is wasted maintaining the magnetic field which latches the relay circuit.

In the preferred embodiment, the current storage device consists of a capacitor 14 connected in series with the current source and the coil and having a capacitance sufficient to permit current flow through the coil for the appropriate period. Once current flow is initiated, it will continue until the capacitor is charged, at which point current will no longer flow. The current flow through the coil must be sufficient to move the permanent reagent from one delimiting position to the other by magnetic attraction or repulsion and to magnetize the core. It will be apparent to those of ordinary skill that a variety of other analog components or digital timing circuits may serve the same function.

Figure 1B:
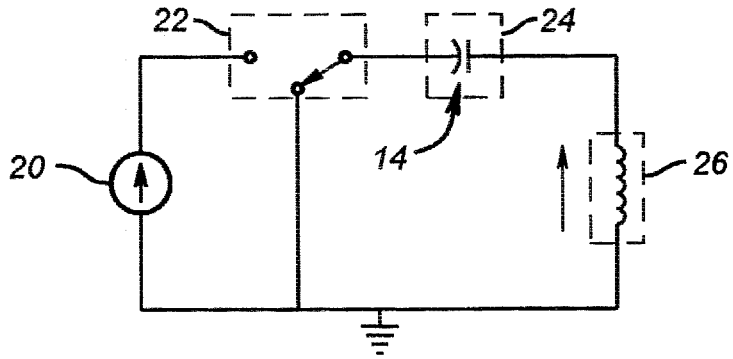
FIG. 1*b* is a circuit diagram illustrating the electrical connections for one embodiment of the present invention with the switching device in a second position.
Figure 2:
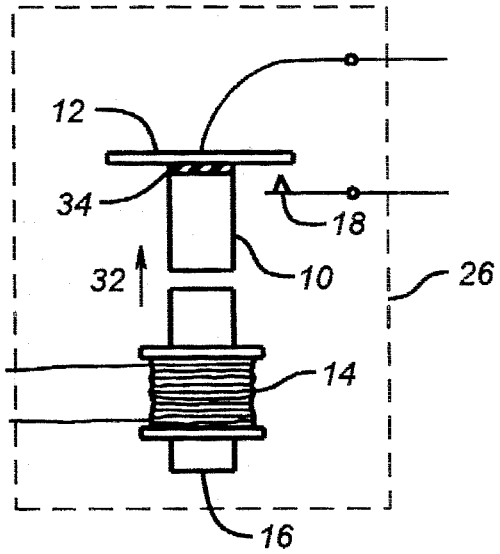
FIG. 2 is a front view of selected components of the present invention when the relay is latched in an open position.

The switching device connects the current source to the coil, selectively permitting current from the current source to flow through the coil in either direction. To increase the circuit's energy efficiency, however, the switching device preferably permits current from the current source to flow through the coil in one direction only. Current flow through the coil in the opposite direction results from the capacitor discharging through the coil after the current source has been disconnected by moving the switching device from one position to a second position. In a preferred embodiment, the switching device is a double pole, single throw switch as shown in FIG. 1. When the switch is in the first position, as shown in FIG. 1*a*, current flows from the current source through the capacitor and the current conducting coil until the capacitor is charged, moving the permanent magnet from one delimiting position to the other. When the switch is subsequently moved to a second position, as shown in FIG. 1*b*, the capacitor discharges through the current conducting coil, thus moving the permanent magnet back to the delimiting position it previously occupied.

Many modifications and variations may be made in the embodiments described herein and depicted in the accompanying drawings without departing from the concept of the present invention. Accordingly, it is clearly understood that the embodiments described and depicted herein are illustrative only and are not intended as a limitation upon the scope of the present invention.

What is claimed is:

1. An electromagnetic latching relay circuit comprising:

a) a permanent magnet having north and south poles and movable between a first position and a second position;

b) a first electrical contact attached to and movable with said permanent magnet;

c) a current-conducting coil capable of generating a magnetic field aligned with said north and south poles of said permanent magnet and moving said permanent magnet between said first and second positions;

d) a magnetizable core disposed within and magnetized by said coil, said core being capable of maintaining a magnetic field when no current is conducted through said coil;

e) a second contact engaging said first contact when said permanent magnet is in said first position;

f) a current source electrically coupled to said coil;

g) a switching device capable of selecting the direction of and initiating said current flow through said coil, said current flow generating a magnetic field which magnetizes said core and moves said permanent magnet from one of said first or second positions to the other of said first or second positions, thereby engaging or disengaging said first and second contacts; and h) a current storage device limiting said current flow.

2. The circuit of claim I wherein said magnetizable core is comprised of an Alnico alloy.

3. The circuit of claim 2 wherein the current storage device comprises a capacitor electrically coupled to said coil.

4. The circuit of claim 3 wherein said switching device has first and second positions for respectively electrically connecting said current source to said coil and electrically disconnecting said current source from said coil.

5. The circuit of claim 4 wherein said capacitor discharges through said coil when said switching device is moved from said first position to said second position.

6. The circuit of claim 2 further comprising a member linked to and moving in tandem with said permanent magnet.

7. The circuit of claim 2 wherein the second contact is attached to a housing enclosing the permanent magnet, the first contact, the core, and the coil.

8. The circuit of claim 2 wherein said current source is a battery.

9. The circuit of claim 2 wherein said switching device is a double pole, single throw switch.

10. An electromagnetic latching relay circuit comprising:

a) a permanent magnet having north and south poles and movable between a first position and a second position;

b) a first electrical contact attached to and movable with said permanent magnet;

c) a current-conducting coil capable of generating a magnetic field aligned with said north and south poles of said permanent magnet and moving said permanent magnet between said first and second positions;

d) a magnetizable core disposed within and magnetized by said coil, said core being capable of maintaining a magnetic field when no current is conducted through said coil;

e) a second electrical contact engaging said first contact when said permanent magnet is in said second position;

f) a current source electrically coupled to said coil;

g) a switching device capable of selecting the direction of and initiating said current flow through said coil, said current flow generating a magnetic field which magnetizes said core and moves said permanent magnet from one of said first or second positions to the other of said first or second positions, thereby engaging or disengaging said first and second contacts, said switching device having first and second positions for respectively electrically connecting said current source to said coil and electrically disconnecting said current source from said coil; and h) a capacitor capable of discharging through said coil when said switching device is moved from said first position to said second position.

11. The circuit of claim 10 wherein said permanent magnet is slidably moveable between said first and second positions. second positions, thereby engaging or disengaging said first and second contacts, said switching device having first and second positions for respectively electrically connecting said current source to said coil and electrically disconnecting said current source from said coil; and h) a capacitor capable of discharging through said coil when said switching device is moved from said first position to said second position.

12. An electromagnetic latching relay circuit comprising:

a) a permanent magnet having north and south poles and movable between a first position and a second position;

b) a first electrical contact including a disk attached to and movable with said permanent magnet;

c) a current-conducting coil capable of generating a magnetic field aligned with said north and south poles of said permanent magnet and moving said permanent magnet between said first and second positions;

d) a magnetizable core comprising an Alnico alloy disposed within and magnetized by said coil, said core capable of maintaining a magnetic field when no current is conducted through said coil;

e) a second electrical contact attached to a housing encompassing the permanent magnet, the first contact, the core, and the coil, said second contact engaging said first contact when said permanent magnet is in said first position;

f) a current source electrically coupled to said coil;

g) a switching device capable of selecting the direction of and initiating said current flow through said coil, said current flow generating a magnetic field which magnetizes said core and moves said permanent magnet from one of said first or second positions to the other of said first or second positions, thereby engaging or disengaging said first and second contacts, said switching device having first and second positions for respectively electrically connecting said current source to said coil and electrically disconnecting said current source from said coil; and h) a current storage device limiting said current flow through said coil to a period not substantially longer than necessary to magnetize said core by said current flow.

13. The circuit of claim 12 wherein said current storage device comprises a capacitor.

* * * * *